US007878107B2

(12) United States Patent
Moretti

(10) Patent No.: US 7,878,107 B2
(45) Date of Patent: Feb. 1, 2011

(54) LOCKING AND RECOCKING ASSEMBLY WITH SWIVEL BREECH-LOCK AND ROTATING LOCKING HEAD, PARTICULARLY FOR INERTIALLY-ACTUATED WEAPONS USING THE KINETIC ENERGY OF RECOIL

(75) Inventor: Luigi Moretti, Brescia (IT)

(73) Assignee: Benelli Armi, S.p.A., Urbino, Pesaro Urbino (IT)

( * ) Notice: Subject to any disclaimer, the term of this patent is extended or adjusted under 35 U.S.C. 154(b) by 0 days.

(21) Appl. No.: 12/217,765

(22) Filed: Jul. 8, 2008

(65) Prior Publication Data

US 2009/0019754 A1 Jan. 22, 2009

(30) Foreign Application Priority Data

Jul. 20, 2007 (IT) ..... MI2007A1474

(51) Int. Cl.
*F41A 3/26* (2006.01)

(52) U.S. Cl. ..... 89/188; 89/19

(58) Field of Classification Search ..... 89/19, 89/21, 174, 188
See application file for complete search history.

(56) References Cited

U.S. PATENT DOCUMENTS

| | | | | |
|---|---|---|---|---|
| 4,615,132 | A * | 10/1986 | Smith | 42/25 |
| 6,484,430 | B1 * | 11/2002 | Robinson et al. | 42/25 |
| 6,971,202 | B2 * | 12/2005 | Bender | 42/16 |
| 2006/0070288 | A1 * | 4/2006 | Zedrosser | 42/25 |

* cited by examiner

*Primary Examiner*—Stephen M Johnson
(74) *Attorney, Agent, or Firm*—R. Neil Sudol; Coleman Sudol Sapone, P.C.

(57) ABSTRACT

A locking and recocking assembly with swivel breech-lock and rotating locking head particularly designed for inertially-actuated weapons, which combines in a single assembly all the functions for locking, opening, case ejection and recocking with locking return, required for correct operation of the weapon; those functions were, until now assigned to various components variously assembled on the weapon. The locking and recocking assembly with swivel breech-lock and rotating locking head has the entire mass, required for inertial operation, concentrated in the swivel breech-lock, which is accommodated completely within the supporting structure of the weapon, such as the sheath or barrel extension or breech of the weapon. All this leads to better balancing and stability of the weapon, higher reliability in operation, greater constructive simplicity and ease of assembly and disassembly.

12 Claims, 8 Drawing Sheets

LOCKING AND RECOCKING ASSEMBLY WITH SWIVEL BREECH-LOCK AND ROTATING LOCKING HEAD, PARTICULARLY FOR INERTIALLY-ACTUATED WEAPONS USING THE KINETIC ENERGY OF RECOIL

BACKGROUND OF THE INVENTION

1. Field of the Invention

The present invention relates to a locking and recocking assembly with swivel breech-lock and rotating locking head, particularly for inertially-actuated weapons which use the kinetic energy of recoil.

2. Description of the Prior Art

Inertially-actuated weapons have long been known in which the recoil of the weapon is used to store energy by means of the compression of a spring which is interposed between the breech and the locking head and to exploit its elastic reaction to power the various operations of the recocking cycle: closure, opening, case extraction and expulsion, trigger arming, compression of the breech recovery spring, return to closure with insertion of the new cartridge in the barrel.

All these functions are traditionally performed by various components which are mounted on the weapon in different positions in relation to the technical solution used.

There are systems in which the inertial mass is constituted mainly by a swivel breech-lock, which slides within the receiver or barrel extension, by a linkage spring guiding pin and corresponding spring, which performs a translational motion within a tube inside the stock, and by a linkage, which is jointly connected to the swivel breech-lock and acts as a connection between these two parts.

Other systems are known in which the inertial mass is constituted mainly by a swivel breech-lock and by one or more straps which are connected thereto and which, by sliding jointly with the breech, compress the recovery spring arranged inside the guide rod of the weapon.

There are other systems with a rotating locking head in which the couplings that ensure the translational motion of the locking head and of the swivel breech-lock are constituted generally by guides provided on the barrel extension or on the receiver while the combined rotary and translational motion of the head with respect to the swivel breech-lock for locking and opening the firing chamber is actuated by a cam.

There are systems with a spike-type closure in which the relative translational motion of the breech and of the head is actuated, by way of inclined planes, by a spike which engages a seat formed on the barrel extension.

All the traditional systems described above for ejecting the case exploit the impact of the bottom of the cartridge against an expulsion body, which is preloaded by a spring, both accommodated on the barrel extension or on the receiver.

The systems described above are generally constructively complicated and expensive, less reliable due to the large number of components used, and difficult to maintain.

SUMMARY OF THE INVENTION

The aim of the present invention is to provide a locking and recocking assembly, with swivel breech-lock and rotating closing head, particularly for inertially-actuated weapons which use the kinetic energy of recoil, which overcomes the drawbacks of the cited prior art.

Within the scope of this aim, an object of the invention is to provide a locking and recocking assembly which provides a better balancing and stability of the weapon.

Another object of the invention is to provide a locking and recocking assembly which is constructively simple and is capable of ensuring high reliability in operation.

Another object is to provide a locking and recocking assembly which is easy to assemble and disassemble.

This aim and these and other objects which will become better apparent hereinafter are achieved by a locking and recocking assembly with swivel breech-lock and rotating closing head, particularly for inertially-actuated weapons which use the kinetic energy of recoil, comprising a single body which is inserted in a sheath or barrel extension of a portable weapon, said single body comprising a closure means, for the stable closure of the firing chamber of the weapon, an opening means, a means for expelling the case, and a recocking means with return to locking; said single body being accommodated completely within the supporting structure of the weapon, such as the sheath or barrel extension or breech of the weapon.

The locking and recocking assembly, with swivel breech-lock and rotating closing head, according to the present invention, has all the mass, required for its inertial operation, concentrated exclusively on the swivel breech-lock which, by being accommodated within the supporting structure of the weapon, such as the sheath or barrel extension or breech of the weapon is the member onto which the main innovative components of the system are assembled.

The swivel breech-lock in fact accommodates a rotating locking head which provides the closure and opening of the firing chamber of the weapon by way of a rotary motion determined by a helical cam provided on its shank, with the contribution of helical inclined planes which mutually converge and are formed both on the rotating closing head and on the swivel breech-lock, capable of avoiding any bouncing of the swivel breech-lock when, during locking, it abuts against the spring of the inertial system.

The swivel breech-lock has a seat which accommodates the ejector of the weapon with the corresponding spring and spring guiding pin, which, by virtue of their particular arrangement on the assembly, in addition to ejecting the case, also perform respectively the function of an auxiliary recovery spring, in the first step of the locking action, and of lateral guide of the cartridge during lifting and insertion in the firing chamber of the weapon.

The recovery spring and the corresponding spring guiding pin are mounted on the swivel breech-lock; thanks to these components, in addition to providing for the return to the locking position of the breech-lock assembly after the step for opening and ejecting the case, one achieves, by virtue of their particular shape and arrangement on the assembly, both the guiding of the rotating closing head throughout the recocking stroke of the breech assembly, and the upper abutment of the cartridge during lifting and insertion into the firing chamber of the weapon during the subsequent step for return to locking of the breech-lock assembly.

A damper is connected directly, by means of plates and with the aid of the recovery spring guiding pin and the ejector spring guiding pin, to the locking and recocking assembly with swivel breech-lock and rotating closing head according to the present invention. The damper dampens the impact of the swivel breech-lock against its stroke limit during opening, during which the entire assembly is always kept guided by a tab of the pivot for the rotation of the closing head, which also is mounted on the swivel breech-lock and engages a seat formed inside the sheath or barrel extension of the weapon.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DESCRIPTION OF THE PREFERRED EMBODIMENTS OF THE INVENTION

Figure 1:
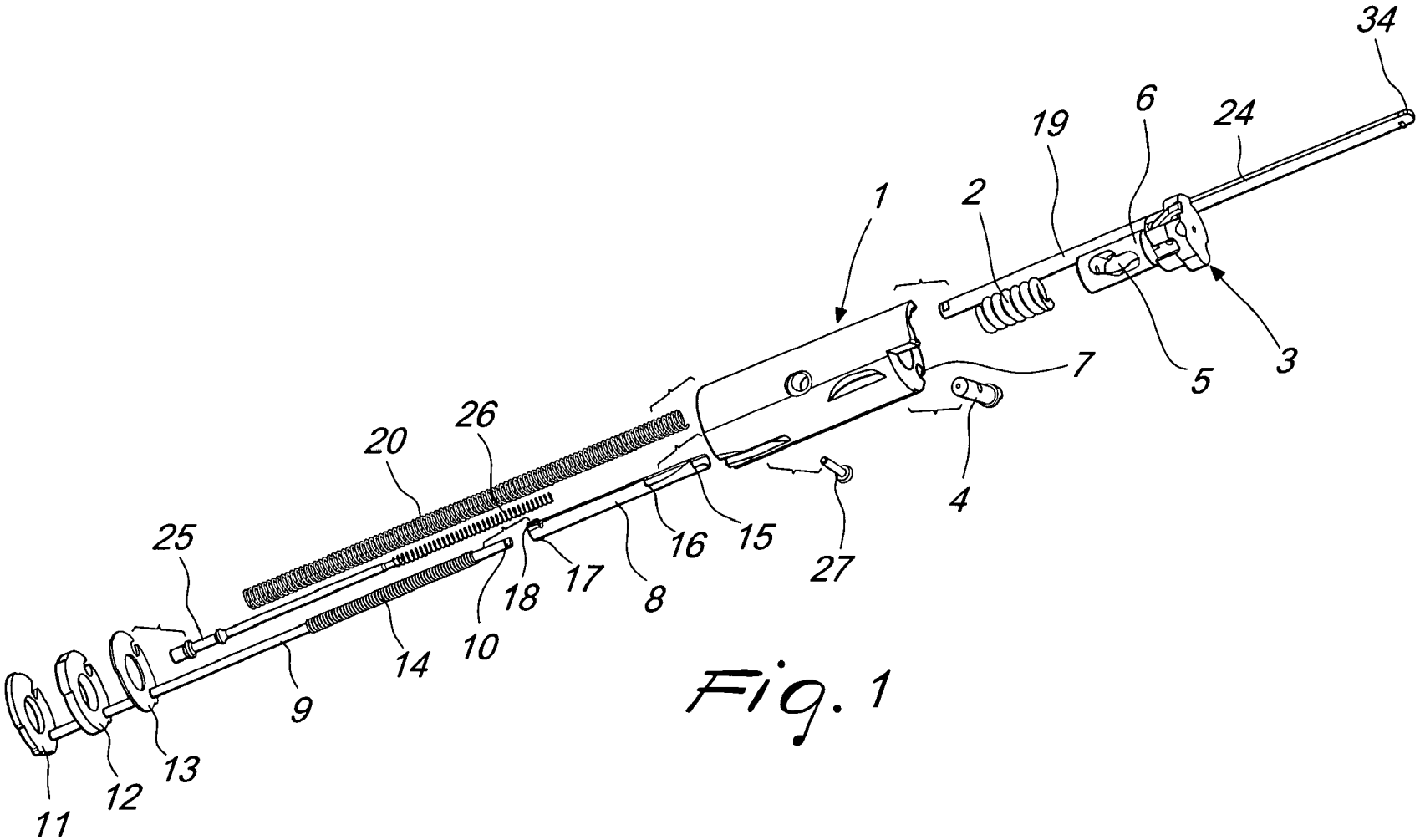
FIG. 1 is an exploded perspective view of the locking and recocking assembly with swivel breech-lock and rotating locking head.

With reference to the cited figures, the locking and recocking assembly with swivel breech-lock and rotating locking head according to the invention comprises a breechblock 1 in which a breech-lock recoil spring 2 is inserted and in which a rotating locking head 3 is mounted. Inasmuch as breechblock 1 carries a rotating or swiveling locking head 3 and houses a breech-lock recoil spring 2, the term "swivel breech-lock' is used to denote breechblock 1 herein.

The rotating locking head 3 is jointly connected to the breech-lock 1 by means of a head rotation pivot 4, which in order to concentrate all the movable mass required for the operation of the weapon on the breech-lock is jointly connected to the breech-lock and engages a helical cam 5 provided on a cylindrical shank 6 of the locking head.

This construction of the swivel breech-lock 1 minimizes the removals of material on the breechblock and allows to therefore maximize its mass.

An ejector body 8 is then inserted in a seat 7 which is provided on the swivel breech-lock 1.

A guiding pin 9, provided at the front with an orientation milling 10, is inserted within the ejector body 8.

The guiding pin 9 is fastened to a spring guiding pin anchoring plate 11 and has, mounted in sequence, a damper 12, in order to cushion the impact of the swivel breech-lock on its stroke limiter, a breech-lock abutment plate 13, on which the stroke of the swivel breech-lock ends during opening, and an ejector spring 14.

Figure 11:
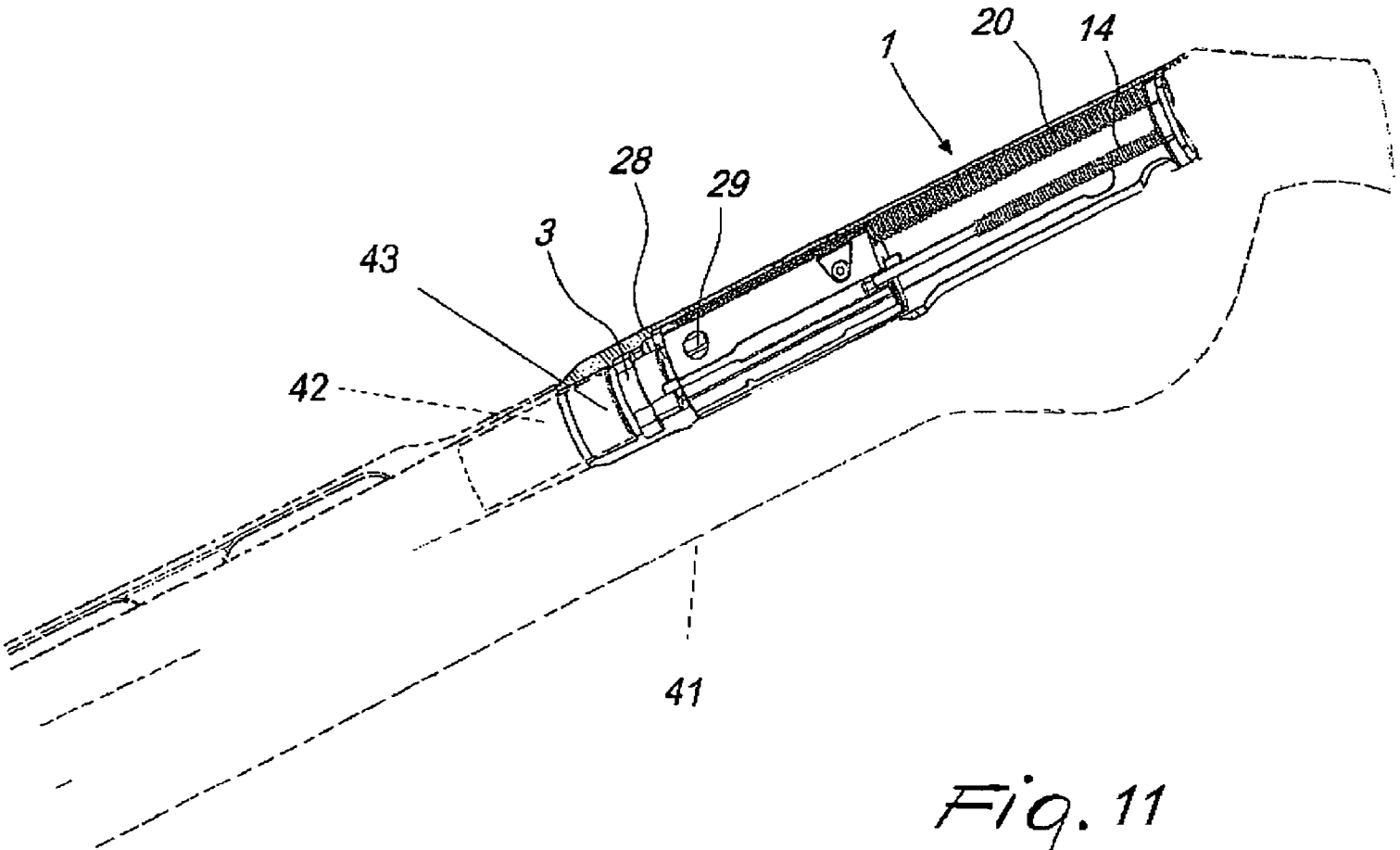
FIG. 11 is a perspective view, partially in cross-section, of a locking and cocking assembly in accordance with the present invention, depicting the relative position of the locking and cocking assembly in a weapon, shown in phantom lines.

The ejector body 8, which is substantially tubular, has in its front portion a front abutment 15 against which, during the opening of the breech-lock, the case collides in order to be expelled from the weapon 41 (FIG. 11).

The front portion of the ejector body 8 has a recessed portion 16 which allows the passage of the cartridge 42 (FIG. 11) during lifting and insertion in the firing chamber. The ejector body 8 has, on its rear portion, two tabs 17 and 18, which, when assembled, define its relative longitudinal movement with respect to the swivel breech-lock 1 and prevent its rotation The position of the ejector 8 on the locking and recocking assembly is such that it allows the ejector spring 14 to operate also as an auxiliary recovery spring, during the first step of the locking action, and allows the ejector spring guiding pin 9 to guide the cartridge 42 laterally in its step for lifting and insertion into the firing chamber of weapon 41.

Also on the oscillating breech-lock 1, a recovery spring guiding pin 19 is inserted through a hole and the recovery spring 20 is mounted to the rear on a groove and allows the swivel breech-lock 1 to return to the locking position.

Figure 3:
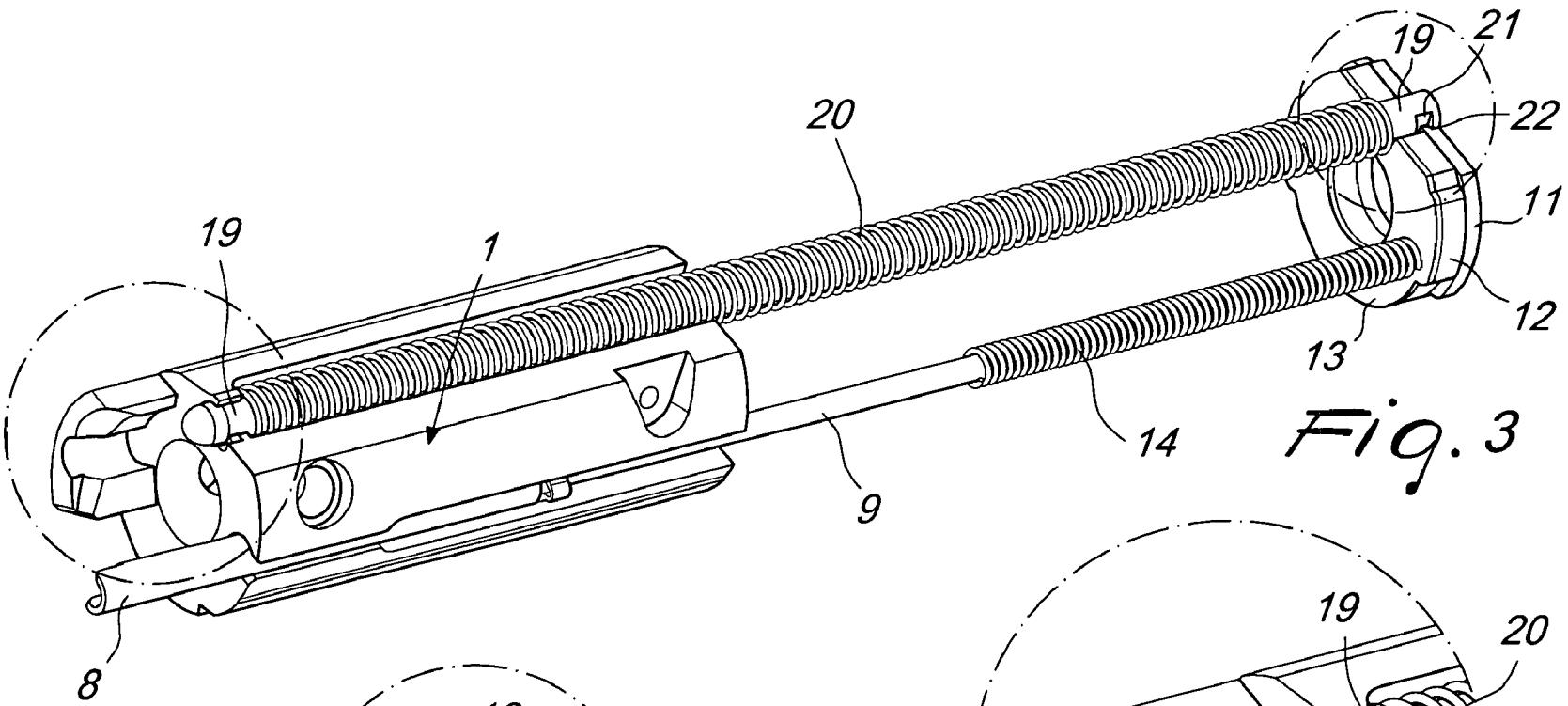
FIG. 3 is a partially cutout perspective view of the locking and recocking assembly with the recovery spring and the corresponding guiding pin mounted on the swivel breech-lock.
Figure 4:
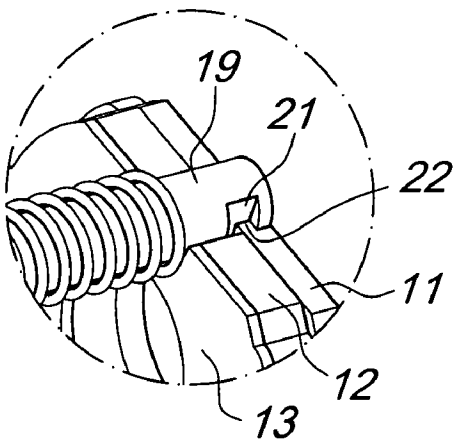
FIG. 4 is an enlarged view, with respect to the preceding figure, which shows in detail the assembly of the recovery spring guiding pin on the pin anchoring plate.

As shown more clearly in FIGS. 3 and 4, the recovery spring guiding pin 19, inserted in the swivel breech-lock 1, passes through the breech-lock abutment plate 13, on which the recovery spring 20 rests.

The recovery spring guiding pin 19 passes through the damper 12 and engages, with its rear end 21, the spring guiding pin anchoring plate 11, by means of the recess 22 of the plate 11 itself.

Figure 2:
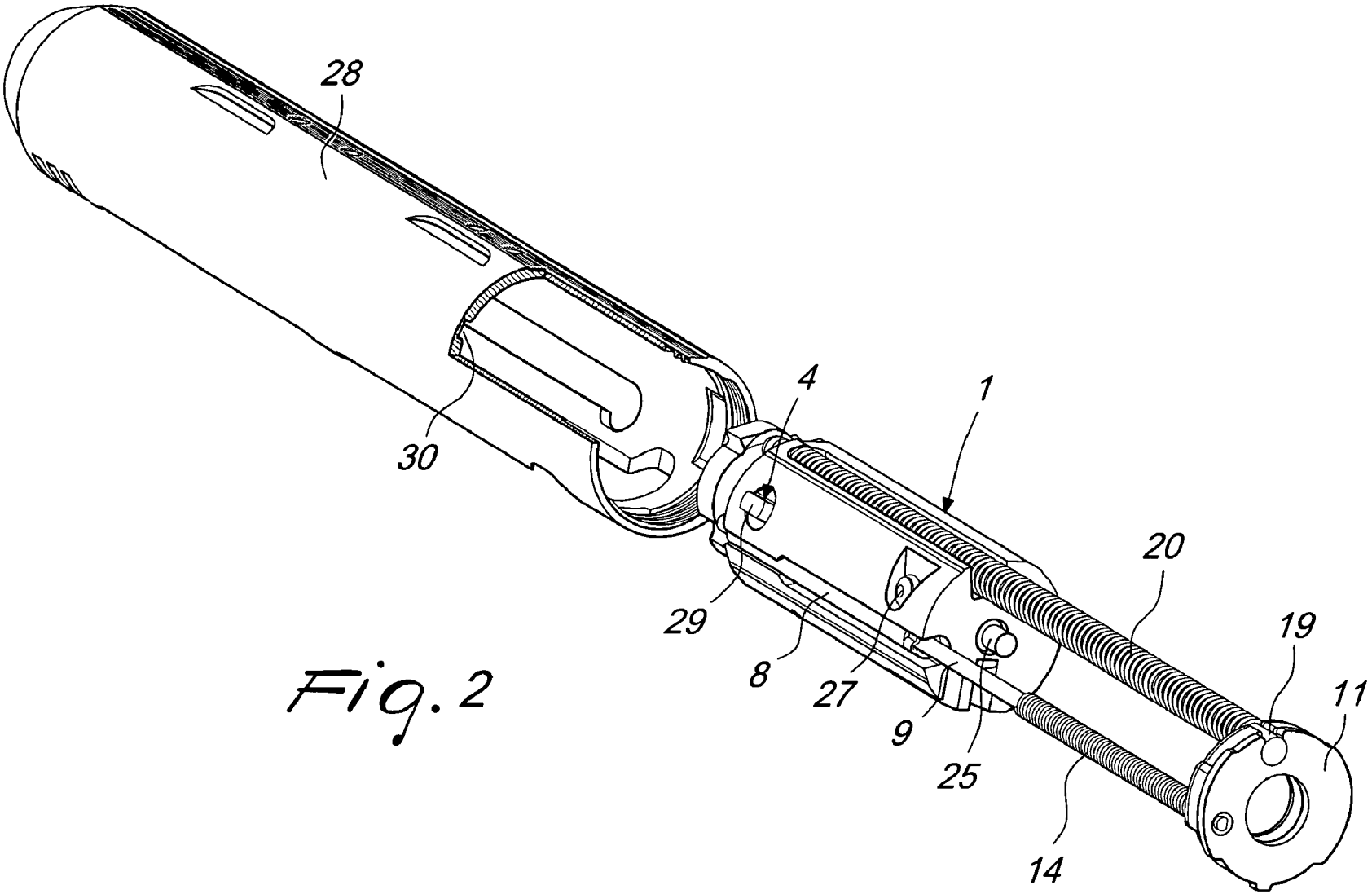
FIG. 2 is a perspective view of the locking and recocking assembly in the fully assembled condition, in the position for insertion on its seat, within the sheath or barrel extension.
Figure 5:
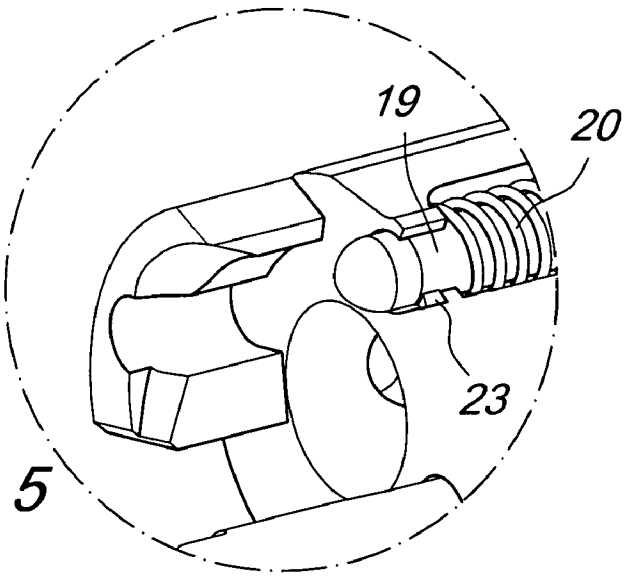
FIG. 5 is a view, enlarged with respect to FIG. 3, showing in detail the assembly of the recovery spring guiding pin on the swivel breech-lock.

As shown more clearly in FIGS. 3 and 5, a protrusion 23, which the recovery spring guiding pin 19 has on its front side, constitutes, when the pin is engaged on the recess 22, a front coupling of the swivel breech-lock 1 by which the entire locking and recocking assembly is completely assembled, as shown in FIG. 2.

The relative position of the recovery spring guiding pin 19 is such that when the assembly is mounted, the flat region 24 provided on its front portion allows to use the pin both as a guide for the case, before its ejection, and as an upper abutment for the cartridge 42 during lifting and insertion in the firing chamber 43 (FIG. 11).

The recovery spring guiding pin 19 also acts as a guide for the rotating locking head 3 for the entire opening and closing stroke of the swivel breech-lock 1.

A firing pin 25 is mounted on the swivel breech-lock 1 and, being inserted in the corresponding spring 26, passes through the rotating locking head 3, the head rotation pivot 4, and the breech-lock. The firing pin 25 is jointly connected to the breech-lock by means of a stop pin 27.

As shown more clearly in FIG. 2, the assembled locking and recocking assembly is mounted inside the supporting structure of the weapon, in the specific case of the sheath or barrel extension 28, orienting and engaging the tab 29 of the head rotation pivot 4 on a slot 30 which is provided inside the barrel extension.

Figure 6:
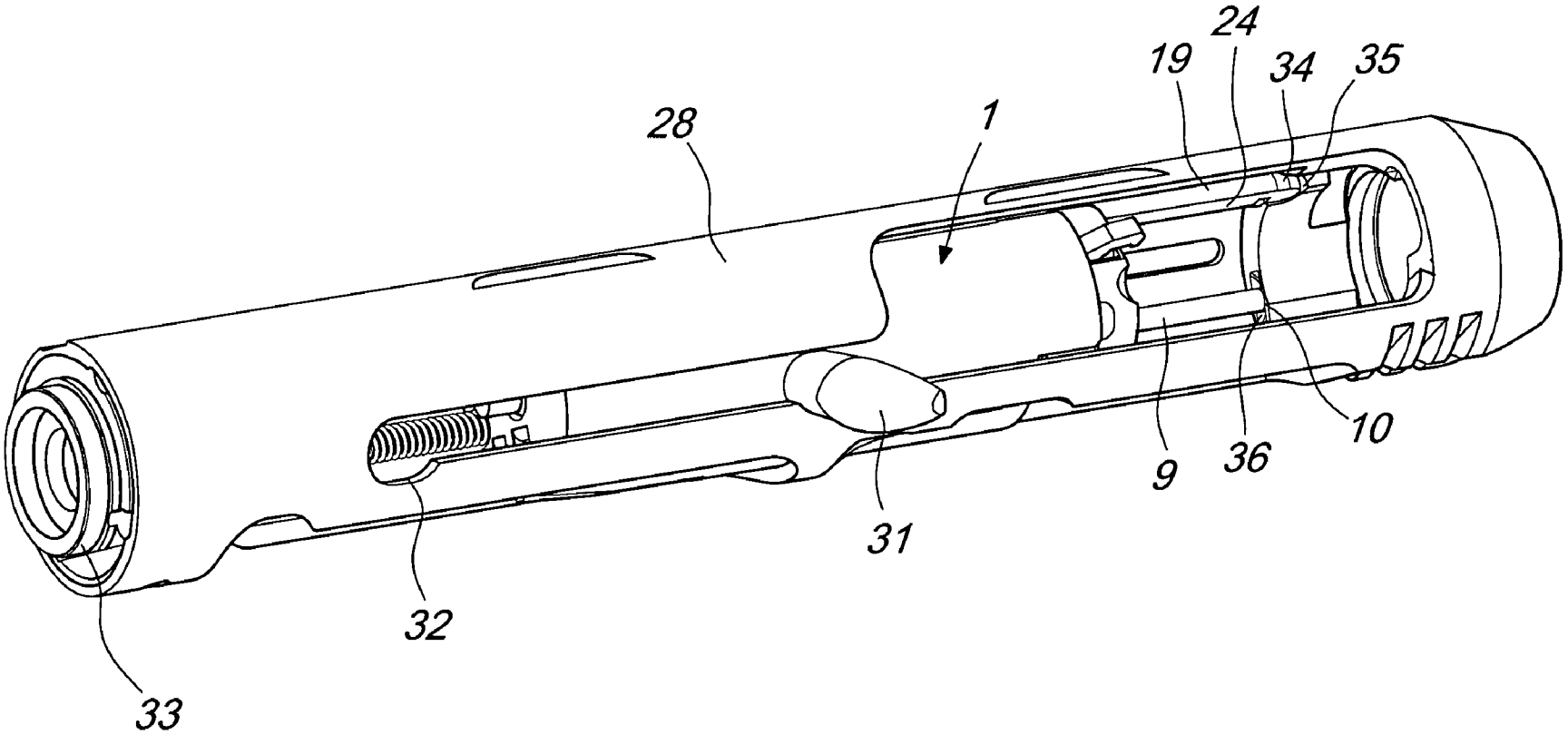
FIG. 6 is a perspective view of the locking and recocking assembly mounted on the sheath or barrel extension.

As shown more clearly in FIG. 6, a cocking knob 31 is inserted in the assembly and is mounted on the swivel breech-lock 1 through the slot 32 of the sheath or barrel extension 28.

The slot 32 is provided at the opening overtravel position of the breech-lock, so that, during normal operation of the weapon, it cannot be disassembled.

As shown more clearly in FIG. 6, when the entire locking and recocking assembly is completely mounted on the sheath or barrel extension 28, and coupled thereat by means of a fastening ring 33, both the recovery spring guiding pin 19 and the ejector spring guiding pin 9 engage, with the respective front ends 34 and 10, in seats 35 and 36 which are formed on the sheath or barrel extension, so as to constitute two stable guides for the sliding of the springs 20 and 14 and of the ejector body 8 and so as to contribute to the guiding of the swivel breech-lock 1 as an aid to the tab 29 of the head rotation pivot 4 engaged on the corresponding seat 30 of the sheath or barrel extension 28 (FIG. 2).

Figure 7:
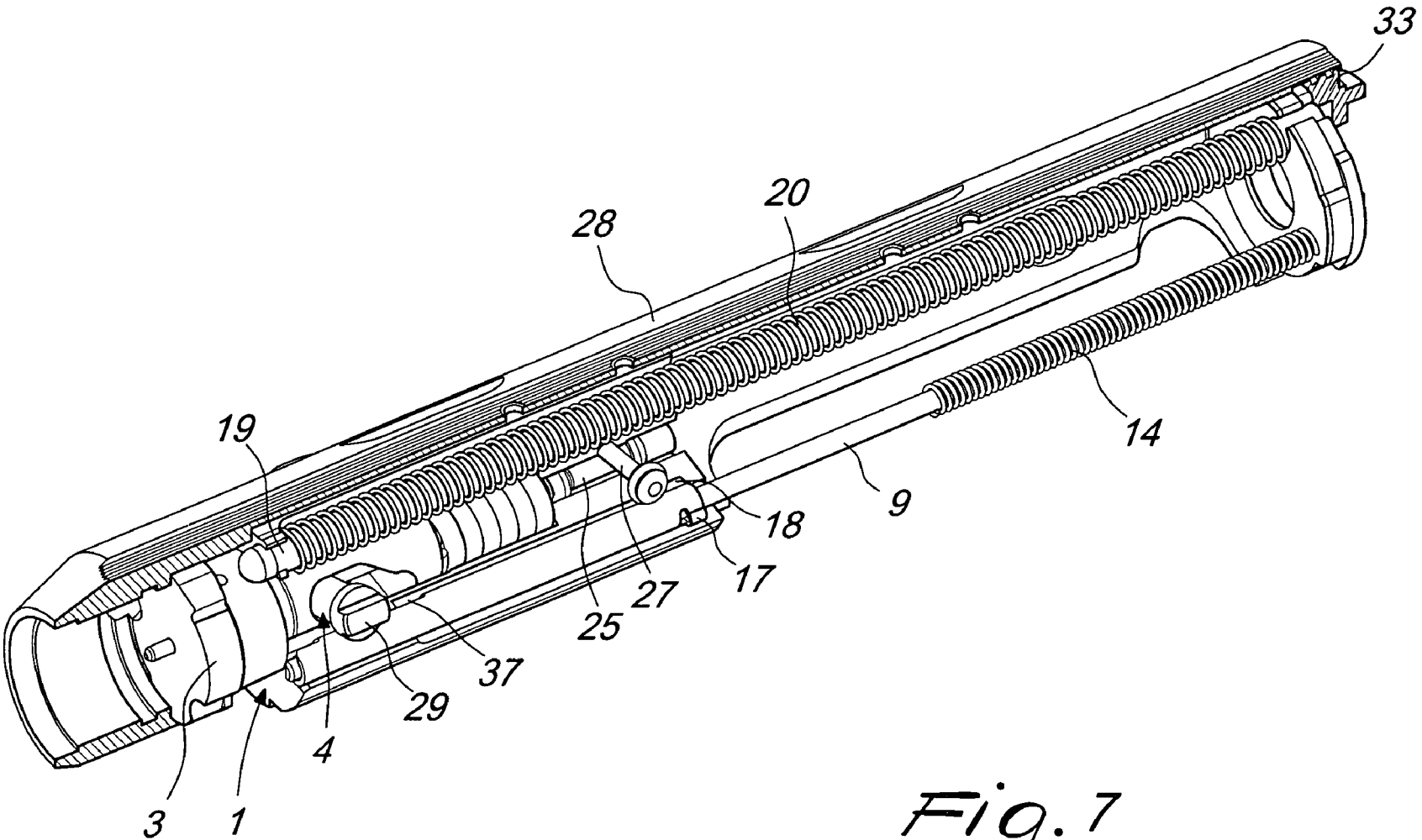
FIG. 7 is a longitudinally sectional perspective view of the locking and recocking assembly mounted on the sheath or barrel extension in the locking position.

With particular reference to FIG. 7, when the swivel breech-lock 1 is in the locked position, and also for a substantial extent of the opening stroke, the spring of the ejector 14 is not loaded and the ejector body 8 is accommodated within the breech-lock.

Starting from a given value of the retraction stroke of the swivel breech-lock 1, the spring of the ejector 14 encounters the ejector body 8 and begins to be loaded, pushing it forward until it protrudes from the locking head 3 (FIG. 8) and strikes the case, which is expelled from the sheath or barrel extension 28.

During its entire stroke, which is defined by the tab 18 which engages within a slot 37 of the swivel breech-lock 1 and prevents its rotation (FIG. 7), the ejector body 8 is guided internally by the ejector spring guiding pin 9 and externally by its other tab 17, which acts on the sheath or barrel extension 28.

Figure 8:
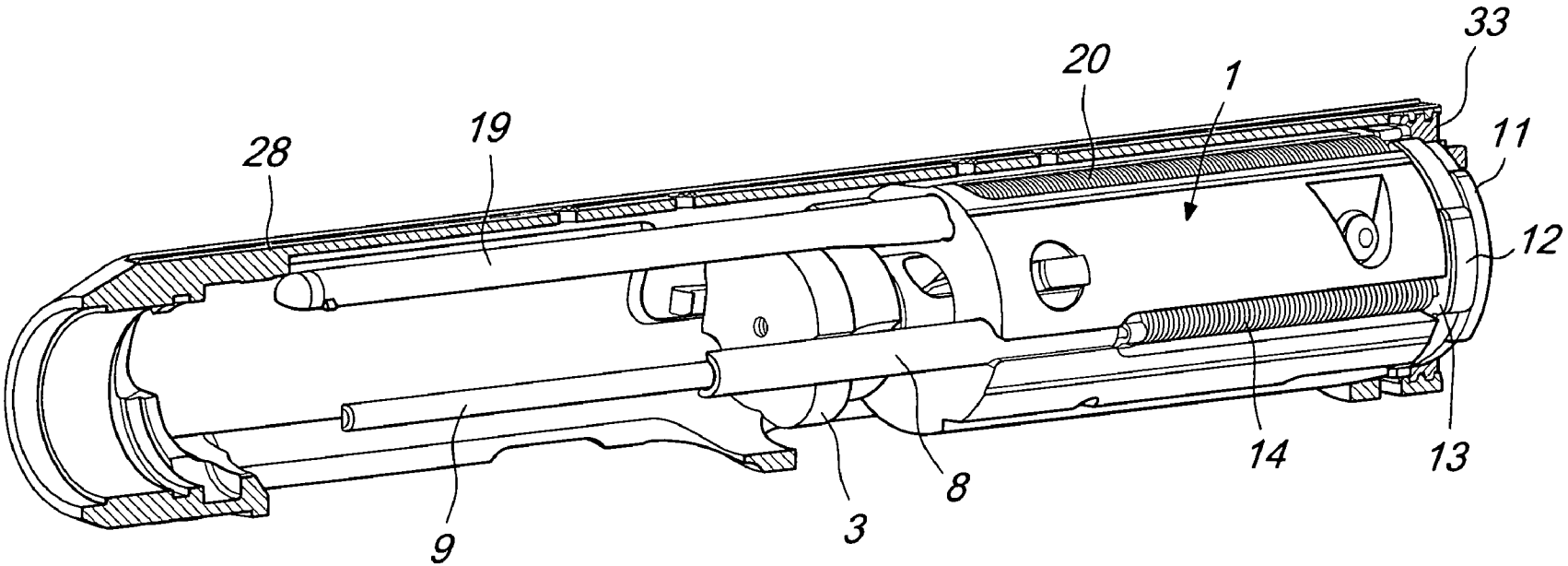
FIG. 8 is a partially sectional perspective view of the locking and recocking assembly mounted on the sheath or barrel extension in the opening stroke limit position.

During the opening stroke, the swivel breechblock 1 compresses both the recovery spring 20, which is guided on the corresponding pin 19, and the ejector spring 14, starting from a certain stroke, thus accumulating the energy required to perform the subsequent locking cycle, as shown schematically in FIGS. 7 and 8.

With particular reference to FIG. 8, once the opening stroke has ended, the swivel breech-lock 1 strikes more or less violently, depending on the energy of the fired cartridge, its stroke limit, which is represented by the internal wall of the fastening ring 33, transferring part of the impact energy to the damper 12, which is interposed between the breech-lock abutment plate 13 and the spring guiding pin anchoring plate 11.

Once the opening stroke has ended, the breech-lock reverses its motion and, biased by the recovery spring 20 and by the ejector spring 14, returns to the closed position, lifting the new cartridge which, being guided laterally by the ejector spring guiding pin 9 and upwardly by the recovery spring guiding pin 19, is inserted in the firing chamber 43.

Figure 9:
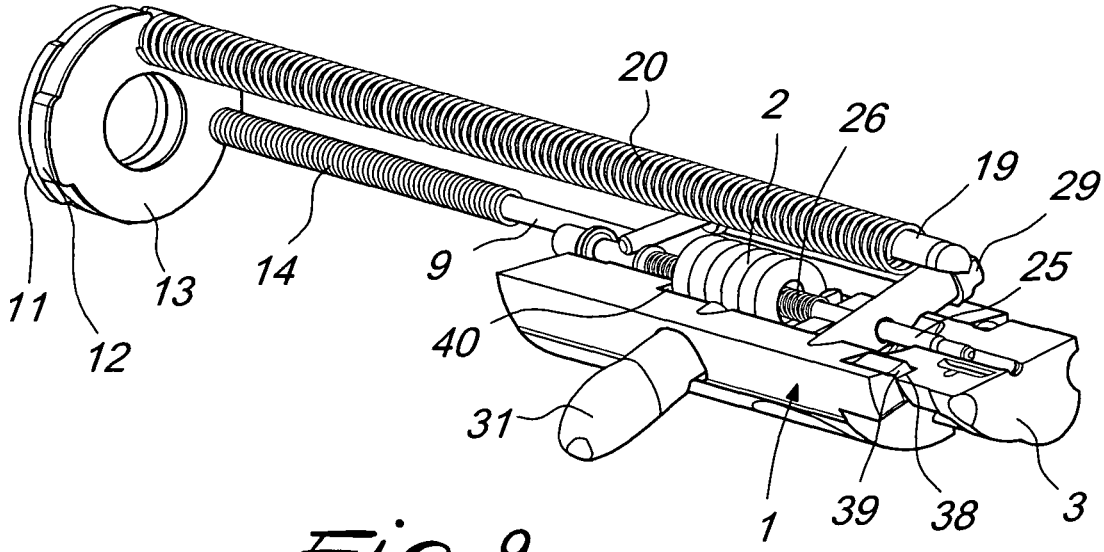
FIG. 9 is a longitudinally sectional perspective view of the locking and recocking assembly illustrating the helical inclined planes provided on the rotating locking head and on the swivel breech-lock.
Figure 10:
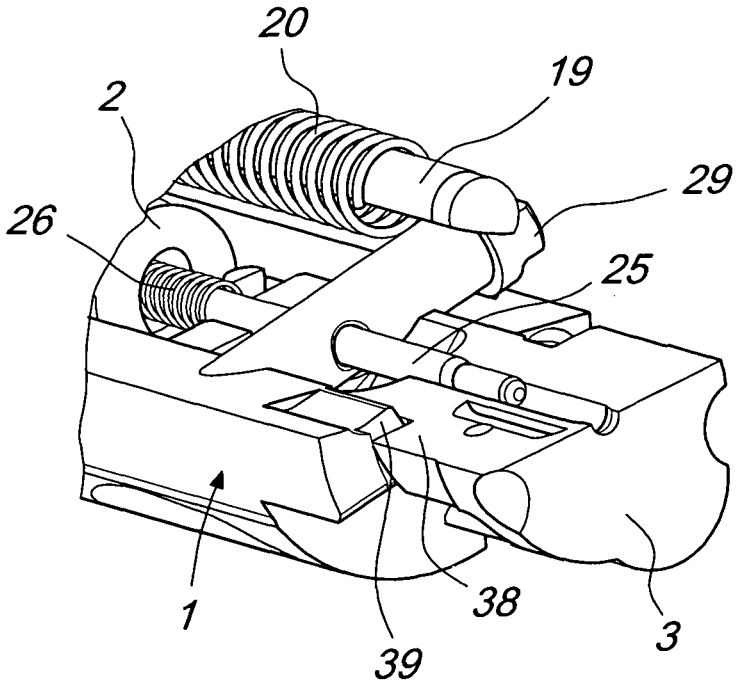
FIG. 10 is a view, enlarged with respect to the preceding figure, showing in detail a longitudinal cutout of the locking and recocking assembly in which the helical inclined planes cited above are highlighted.

With particular reference to FIGS. 9 and 10, in the last step of the locking stroke of the swivel breech-lock 1, the rotation of the closing head 3 occurs by means of the contact of an inclined helical plane 38 thereof against a corresponding inclined helical plane 39 provided on the swivel breech-lock 1.

The contact provides the breech-lock with the speed required to complete the rotation and locking of the head 3, and also dissipates much of the energy that it has acquired due to the thrust of the recovery spring 20, assisted by the ejector spring 14, in the locking stroke.

In this manner, when the locking and recocking assembly is applied to an inertially-actuated weapons system, the swivel breech-lock 1 arrives, with a plane 40 thereof, in abutment against the recoil spring 2, with an energy which is insufficient to compress it, thus avoiding the elastic reactions of the spring which would otherwise generate a rebound and bouncing motion of the swivel breech-lock 1 during locking.

A locking and recocking assembly with swivel breech-lock and rotating closing head, according to the present invention combines, simply and compactly, in a single assembly and exclusively by way of movable connections, all the components required for the cycle for recocking, locking, opening, case ejection and return to locking required for correct operation of the weapon.

The disassembly, as shown schematically in FIG. 1, and assembly, as shown in FIG. 2, can be performed manually, without using tools, providing the mutual couplings exclusively by way of movable connections.

In practice it has been found that the invention achieves the intended aim and objects, combining all the functions of locking, opening, case extraction and ejection, recocking and return to locking in a single locking and recocking assembly which is completely assembled within the sheath or barrel extension of the weapon.

An important and advantageous feature of the assembly according to the present invention is that it concentrates all the mass required for the inertial operation of the system in a single swivel breech-lock body.

Another advantage of the present locking and recocking assembly is that the ejector body, with corresponding spring and spring guiding pin, is mounted directly on the swivel breech-lock so that the ejection spring contributes, together with the recovery spring, also to the recocking of the weapon during locking of the breech-lock and simultaneously the spring guiding pin acts as a lateral guide for the cartridge during lifting and insertion in the firing chamber of the weapon.

Another advantage of the present locking and recocking assembly is that it has the breech-lock recovery spring, and the corresponding spring guiding pin, mounted directly onto the swivel breech-lock so as to be able to use the recovery spring guiding pin both as a guide of the rotating locking head, during the recocking cycle, and as an upper abutment of the cartridge during lifting and subsequent guiding for its insertion in the firing chamber of the weapon.

Another advantage of the present locking and recocking assembly is that, by means of helical contrast planes provided on the rotating locking head and on the swivel breech-lock, it prevents any bouncing of the breech-lock when, during locking, it abuts against the spring of the inertial system which is interposed between the rotating locking head and the swivel breech-lock.

Another advantage of the present locking and recocking assembly is the capability of cushioning the impact of the swivel breech-lock on its opening stroke limit by means of the damper which is connected directly to the swivel breech-lock.

In practice, the present locking and recocking assembly provides a simple and compact system in which all the components in relative motion with respect to the weapon, the inertial mass, the recoil spring, the breech-lock recovery spring, the ejector and the corresponding spring are contained within the sheath or barrel extension of the weapon and move axially with respect to it; this allows to obtain considerable simplifications by eliminating various components, such as the linkage and straps and other minor components needed to connect the swivel breech-lock to the recovery spring which, in the systems of the prior art, is by contrast located within the stock or guide rod of the weapon.

This application claims the priority of Italian Patent Application No. M12007A001474, filed on Jul. 20, 2007, the subject matter of which is incorporated herein by reference.

What is claimed is:

1. A locking and recocking assembly for a weapon, comprising a single body of mutually interconnected parts which are insertable as a self-supporting unit into a sheath or barrel extension of a portable weapon so as to be accommodated completely within the sheath or barrel extension, the parts of said single body including a rotating locking head for the stable closure of a firing chamber of the weapon, a breechblock, a spring-loaded ejector member for expelling a case, and a recocking or recovery spring to return said breechblock to a locking position after opening of the firing chamber and ejecting of the case, said breechblock housing a recoil spring and carrying the rotating locking head for stable closure and locking of the firing chamber of the weapon, said rotating locking head being provided with a helical rotation cam and said rotating locking head and said breechblock being provided with contacting helical surfaces.

2. A locking and recocking assembly for a weapon, comprising a single body of mutually interconnected parts which are insertable as a self-supporting unit into a sheath or barrel extension of a portable weapon so as to be accommodated completely within the sheath or barrel extension, the parts of said single body including a rotating locking head for the stable closure of a firing chamber of the weapon, a breechblock, a spring-loaded ejector member for expelling a case, and a recocking or recovery spring to return said breechblock to a locking position after opening of the firing chamber and ejecting of the case, said breechblock housing a recoil spring and carrying the rotating locking head for stable closure and locking of the firing chamber of the weapon, said rotating locking head being provided with a helical rotation cam and said rotating locking head and said breechblock being provided with contacting helical surfaces, further comprising an ejector spring and a spring guiding pin, said guiding pin extending through said ejector spring and said ejector member, said ejector spring and said spring guiding pin being mounted directly on said breechblock and being adapted to assist in ejecting the case after firing, during the opening of the weapon, said guiding pin serving as a lateral guide of a cartridge during a lifting and insertion of the cartridge into the firing chamber of the weapon, said ejector spring being adapted to assist in returning said breechblock to said locking position.

3. The assembly according to claim 2, further comprising a recovery spring guiding pin mounted together with said recocking or recovery spring directly on said breechblock, said recovery spring guiding pin being adapted for guiding said cartridge during lifting and insertion thereof into the firing chamber of the weapon, said recovery spring guiding pin acting as a guide for the case before an expulsion thereof.

4. The assembly according to claim 3, further comprising a damper which is connected directly to said breechblock and is suitable to cushion the impact of said breechblock against a opening stroke limit of said breechblock.

5. The assembly according to claim 4, wherein said single body can be inserted into and extracted from said sheath or barrel extension without using tools.

6. A locking and recocking assembly for a weapon, comprising a single body of mutually interconnected parts which are insertable as a self-supporting unit into a sheath or barrel extension of a portable weapon so as to be accommodated completely within the sheath or barrel extension, the parts of said single body including:

- a rotating locking head for the stable closure of a firing chamber of the weapon;
- a breechblock;
- a spring-loaded ejector member for expelling a case;
- a recocking or recovery spring to return said breechblock to a locking position after opening of the firing chamber and ejecting of the case;
- a recovery spring guiding pin coupled at a front end to said breechblock;
- an ejector spring;
- an ejector spring guiding pin; and
- a guiding spring anchoring plate spaced from a rear end of said breechblock,
- a rear end of said recovery spring guiding pin being locked to said guiding spring anchoring plate,
- a rear end of said ejector spring guiding pin being fixed to said guiding spring anchoring plate.

7. The assembly according to claim 6, wherein said breechblock houses a recoil spring and carries the rotating locking head for stable closure and locking of the firing chamber of the weapon, said rotating locking head being provided with a helical rotation cam and said rotating locking head and said breechblock being provided with contacting helical surfaces.

8. The assembly according to claim 7 wherein said ejector spring guiding pin extends through said ejector spring and said ejector member, said ejector spring and said spring guiding pin being mounted directly on said breechblock and being adapted to assist in ejecting the case after firing, during the opening of the weapon, said guiding pin serving as a lateral guide of a cartridge during a lifting and insertion of the cartridge into the firing chamber of the weapon, said ejector spring being adapted to assist in returning said breechblock to said locking position.

9. The assembly according to claim 8 wherein said recovery spring guiding pin is adapted for guiding said cartridge during lifting and insertion thereof into the firing chamber of the weapon, said recovery spring guiding pin acting as a guide for the case before an expulsion thereof.

10. The assembly according to claim 9, further comprising a damper which is connected directly to said breechblock and is suitable to cushion the impact of said breechblock against a opening stroke limit of said breechblock.

11. The assembly according to claim 10, wherein said single body can be inserted into and extracted from said sheath or barrel extension without using tools.

12. The assembly according to claim 10, wherein said damper is disposed proximate to said guiding spring anchoring plate.

* * * * *